US010401110B2

(12) United States Patent
Aldophsen

(10) Patent No.: US 10,401,110 B2
(45) Date of Patent: Sep. 3, 2019

(54) SYSTEM FOR IMPROVED WEAPON SYSTEM BARREL

(71) Applicant: Alan Aldophsen, Hope, ME (US)

(72) Inventor: Alan Aldophsen, Hope, ME (US)

(73) Assignee: Teludyne Tech Industries, Inc., Greer, SC (US)

( * ) Notice: Subject to any disclaimer, the term of this patent is extended or adjusted under 35 U.S.C. 154(b) by 0 days.

(21) Appl. No.: 16/041,760

(22) Filed: Jul. 21, 2018

(65) Prior Publication Data

US 2019/0024999 A1 Jan. 24, 2019

Related U.S. Application Data

(60) Provisional application No. 62/535,410, filed on Jul. 21, 2017.

(51) Int. Cl.

| | |
|---|---|
| ***F41A 21/26*** | (2006.01) |
| ***F41A 21/48*** | (2006.01) |
| ***F41A 21/16*** | (2006.01) |
| ***F41A 5/26*** | (2006.01) |
| ***F41A 21/02*** | (2006.01) |
| ***F41A 21/44*** | (2006.01) |
| ***F41A 27/30*** | (2006.01) |
| ***F41C 27/22*** | (2006.01) |

(52) U.S. Cl.

CPC ..... *F41A 21/26* (2013.01); *F41A 5/26* (2013.01); *F41A 21/02* (2013.01); *F41A 21/16* (2013.01); *F41A 21/44* (2013.01); *F41A 21/48* (2013.01); *F41A 27/30* (2013.01); *F41C 27/22* (2013.01)

(58) Field of Classification Search

CPC ..... F41A 21/06; F41A 21/02; F41A 21/04; F41A 21/26; F41A 21/20

USPC ..... 42/76.1, 76.02, 76.01, 77; 89/14.05, 16, 89/14.7

See application file for complete search history.

(56) References Cited

U.S. PATENT DOCUMENTS

| | | |
|---|---|---|
| 1,401,667 A | 12/1921 | Brown |
| 2,249,899 A | 7/1941 | Hogg |

(Continued)

*Primary Examiner* — Reginald S Tillman, Jr.

(74) *Attorney, Agent, or Firm* — Kim and Lahey Law Firm, LLC; Seann P. Lahey; Douglas W. Kim

(57) ABSTRACT

A method of modifying a firearm barrel comprising the steps of milling an existing barrel to create a sloped area with a larger diameter at a chamber end and a small action moving toward the muzzle end; placing an barrel nut on the barrel; placing a chamber bushing having a step with the step disposed at the chamber end; placing a brass pressing guide on the barrel and placing the barrel assemble with brass press guide and rear jacket tube in a press to press fit these components together; placing a gas block on the barrel adjacent to the rear jacket tube pressing the components tougher using the press; placing a front jacket tube on the barrel adjacent to the gas block and pressing the components tougher using the press; covering the threads of the barrel and placing a pour guide on the barrel; filling a void defined between the front jacket tube, rear jacket tube and barrel with a filler; placing a centering device on the barrel so that it is operatively associated with the front jacket tube to center the barrel in the front jacket tube while the filler is curing; placing a muzzle brake cap on the barrel and pressing the muzzle cap into the front jacket tube using the press; and, attacking a muzzle brake.

20 Claims, 7 Drawing Sheets

(56) References Cited

U.S. PATENT DOCUMENTS

| | | | | | |
|---|---|---|---|---|---|
| 2,322,370 | A | | 6/1943 | Lance | |
| 3,727,513 | A | * | 4/1973 | Wicks | F41A 13/12 89/14.05 |
| 4,207,799 | A | | 6/1980 | Tocco | |
| 4,322,999 | A | | 4/1982 | Aston | |
| 4,930,397 | A | | 6/1990 | Seidler | |
| 4,980,407 | A | | 12/1990 | Okumoto et al. | |
| 5,092,223 | A | | 3/1992 | Hudson | |
| 5,136,923 | A | | 8/1992 | Walsh, Jr. | |
| 5,225,615 | A | | 7/1993 | Talbot et al. | |
| 5,355,765 | A | * | 10/1994 | Rogers | F41A 13/12 89/14.4 |
| 5,357,842 | A | | 10/1994 | Reynolds | |
| 5,367,940 | A | | 11/1994 | Taylor | |
| 5,814,757 | A | | 9/1998 | Buss | |
| 6,425,310 | B1 | | 7/2002 | Champion | |
| 7,059,235 | B2 | | 6/2006 | Hanslick et al. | |
| 7,143,680 | B2 | | 12/2006 | Bender | |
| 7,182,014 | B2 | | 2/2007 | Smith | |
| 7,353,741 | B2 | | 4/2008 | Brixius | |
| 8,307,751 | B2 | | 11/2012 | Adolphsen | |
| 8,312,663 | B2 | * | 11/2012 | Johnson | F41A 23/16 42/76.01 |
| 2007/0193102 | A1 | | 8/2007 | Briggs | |
| 2011/0107647 | A1 | | 5/2011 | Johnson | |
| 2011/0113667 | A1 | | 5/2011 | Adolphsen | |
| 2014/0007481 | A1 | * | 1/2014 | Tresserras Torre | F41A 21/02 42/76.1 |

* cited by examiner

SYSTEM FOR IMPROVED WEAPON SYSTEM BARREL

BACKGROUND OF THE INVENTION

1) Field of the Invention

The present invention relates to weapon barrels, and more particularly, to the construction of a rifle, shotgun, or cannon barrel and methods of modification providing a layered barrel design for reducing heat and harmonics and for improving accuracy.

2) Description of Related Art

It has been long understood that a rifle's barrel changes shape and moves in multiple directions every time the rifle is fired. This effect is also found in shotgun and cannon barrels. In some instances, this movement of the barrel has been coined "barrel whip" and is when a weighted object (bullet) travels down the tubular barrel under intense gas pressure generally defined as when the barrel away from its "static" state. Barrel whip can occur when the bullet accelerates into a rapid spin, when the stock drops significantly so the muzzle rises when the rifle is fired, or when a pressure wave travels the length of the barrel. In the case of shotguns and unrifled cannon barrels, the "barrel whip" largely results from the pressure wave traveling along the barrel.

Barrel whip reduces the accuracy of the projectile expelled from the barrel and, therefore, the ability of a shooter to hit a target. Historically, manufacturers of barrels have simply accepted that the barrel's movement can't be eliminated. The remedy was to manufacture the barrel so that at least the movement was consistent with each shot. With a combination of cartridge loads and a consistently moving barrel whip, a rifle can be made more accurate by matching the load with the barrel. However, this requires that cartridge loads be customized to match each individual barrel and requires a high degree of customization.

Further, with each shot, the chamber can swell and produce an annular wave that travels between the muzzle and the breech. As the annular wave travels down the barrel, the bore diameter changes slightly as a result of the wave. If the bullet exits the barrel coincidentally with the wave at the muzzle, the bullet accuracy is greatly reduced since the bore and the bullet will be ejected through a bore that is made larger due to the wave. Traditional attempts to avoid this problem have been to change the cartridge load so that the bullet does not exit the barrel when the annular wave is at the muzzle. Again, this involves a high degree of customization and requires that cartridge loads match each individual barrel.

It would be advantageous to have a weapons system that was manufactured or modified to reduce the effects of barrel whip, annular, or pressure waves, and heat produced when firing. Additionally, it would be advantageous to have a weapons system that was manufactured or modified so that it would not be necessary to match cartridge loads with barrel characteristics so that barrel accuracy was not necessarily cartridge specific.

Accordingly, it is an object of the present invention to provide a weapon barrel manufacturing system that results in a barrel having reduced effects of barrel whip, annular, or pressure waves.

It is a further object of the present invention to provide a weapon barrel manufacturing system that results in a barrel having increased heat dissipation.

It is a further object of the present invention to provide a weapon barrel manufacturing system that results in a barrel having improved harmonic characteristics.

It is a further object of the present invention to provide a weapon barrel manufacturing system that results in a barrel having improved accuracy without overly complicated assembly, expensive custom parts and the like.

SUMMARY OF THE INVENTION

The above objectives are accomplished according to the present invention by providing a method of modifying a firearm barrel comprising the steps of milling an existing barrel to create a sloped area with a larger diameter at a chamber end and a small action moving toward the muzzle end; placing an barrel nut on the barrel; placing a chamber bushing having a step with the step disposed at the chamber end; placing a brass pressing guide on the barrel and placing the barrel assembly with brass press guide and rear jacket tube in a press to press fit these components together; placing a gas block on the barrel adjacent to the rear jacket tube pressing the components tougher using the press; placing a front jacket tube on the barrel adjacent to the gas block and pressing the components tougher using the press; covering the threads of the barrel and placing a pour guide on the barrel; filling a void defined between the front jacket tube, rear jacket tube, and barrel with a filler; placing a centering device on the barrel so that it is operatively associated with the front jacket tube to center the barrel in the front jacket tube while the filler is curing; placing a muzzle brake cap on the barrel and pressing the muzzle cap into the front jacket tube using the press; and, attacking a muzzle brake.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Figure 1:
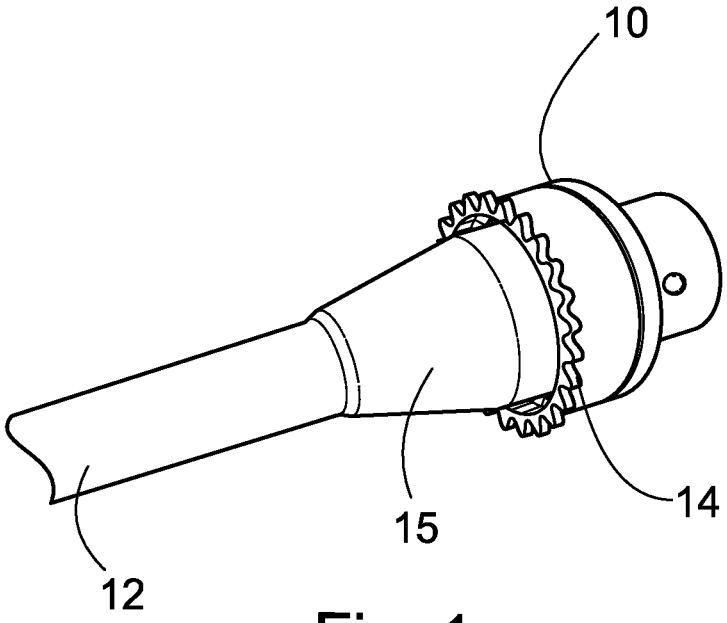
FIGS. 1 through 14 show various perspective views of stages during the barrel manufacturing process according to the present invention.
Figure 2:
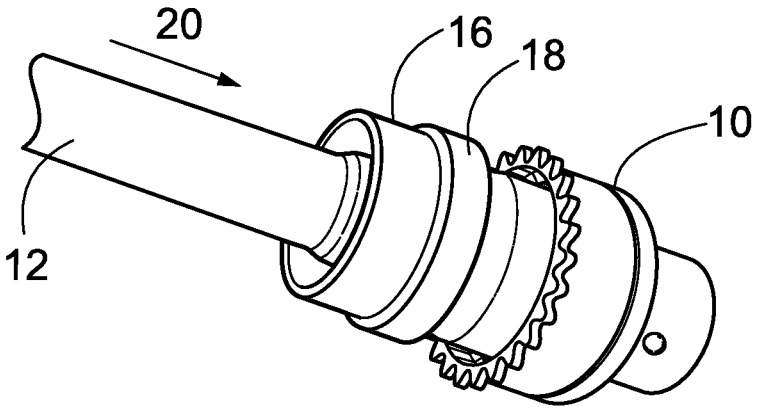

Referring to FIG. 1, a barrel nut 10 can be placed over the barrel 12 with threads towards the breach and knurled end 14 toward the muzzle. Referring to FIG. 2, a chamber bushing 16 can be placed over the barrel 12 with step 18 towards the breach direction, designated generally as 20, and in a position for press fitting. It is preferred the barrel nut 10 is in position prior to hand pressing the chamber bushing 16 in place as a quality control check at this step.

Figure 3:
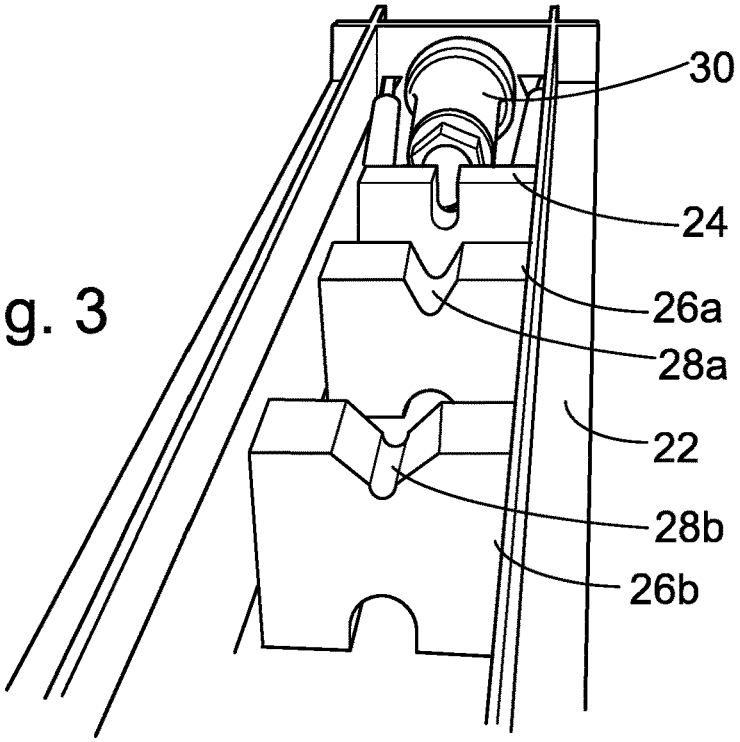

Referring to FIG. 3, a press block 22 is placed in a first position with the press plate 24 disposed at a rear of press block 22. Various supports 26*a* and 26*b* having cutouts 28*a* and 28*b*, respectively, for supporting barrel components placed in press block 22. The press piston 30 is moved to the rear of press block 22 behind press plate 24.

Figure 4:
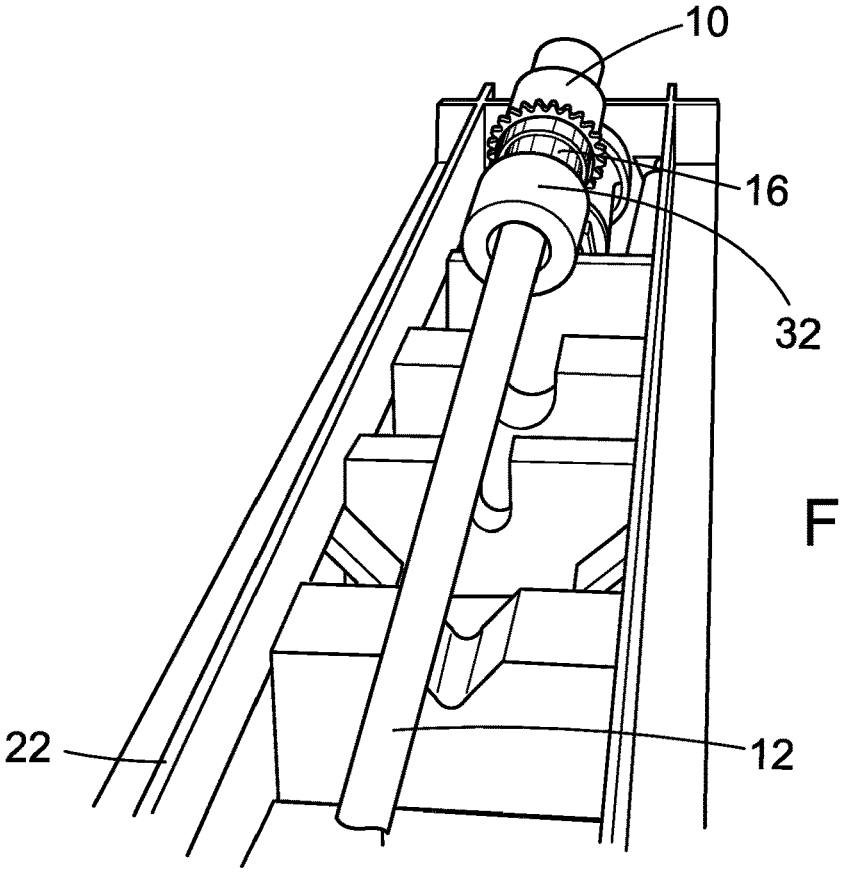

Referring to FIG. 4, barrel 12, barrel nut 10, and chamber bushing 16, along with a brass pressing guide 32 are placed in press block 22. The parts are centered in press block 22 with chamber bushing 16 in place so that there are no gaps between chamber bushing 16 and a milled bushing stop 15 (FIG. 1) on barrel 12 after being pressed together.

Figure 5:
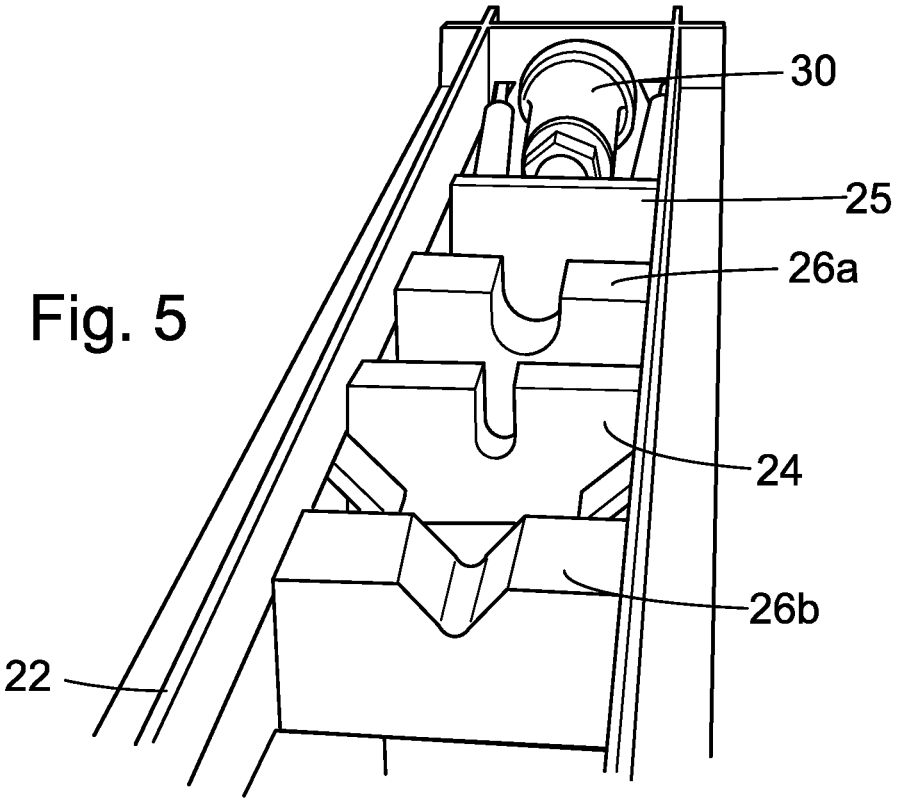

Referring to FIG. 5, the barrel sub-assembly is moved out of the way and press plate 24 is moved into a second position that can be disposed between the supports, for example supports 26*a* and 26*b*. A secondary plate 25 is positioned in from of press piston 30.

Figure 6:
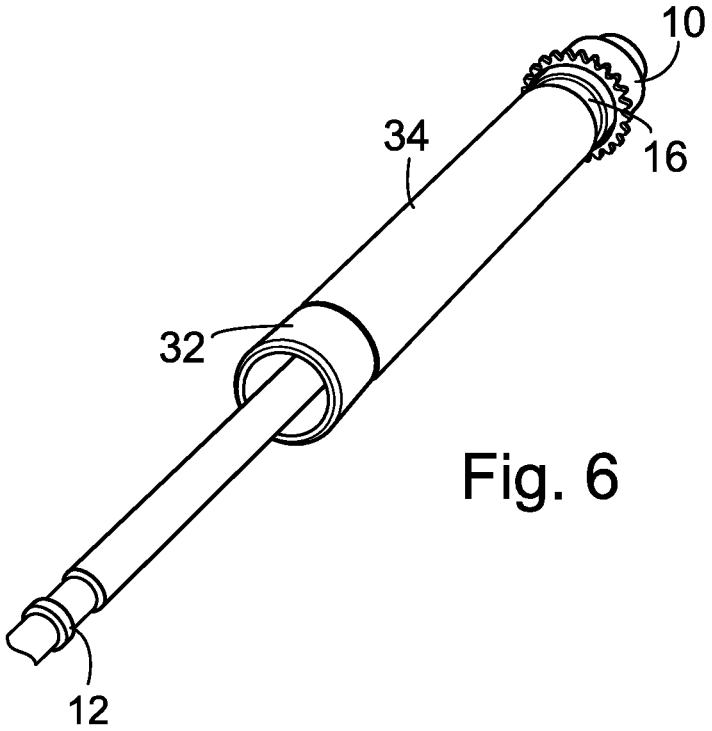

Referring to FIG. 6, a rear jacket tube 34 is placed on chamber bushing 16. The sub-assembly, with brass pressing guide 32 disposed at the end of rear jacket tube 34 opposite chamber busing 16, can then be placed back into press block 22. The press block 22 is then used in cooperation with brass pressing guide 32 and rear jacket tube 34 to press the part together so that there are no gaps between the parts.

Figure 7:
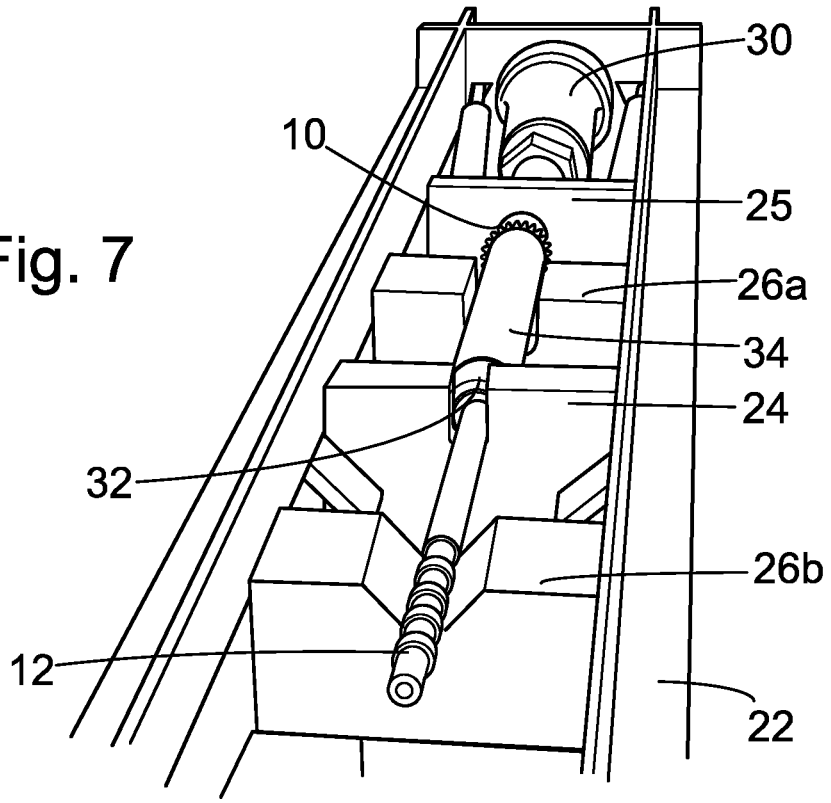

Referring to FIG. 7, the pressure is removed from the sub-assembly and the sub-assembly can be removed from press block 22. The press block 22 is left in its second position with press plate 24 disposed between supports 26*a* and 26*b*, in the illustrate embodiment. The brass pressing guide 32 can be removed from the barrel sub-assembly.

Figure 8:
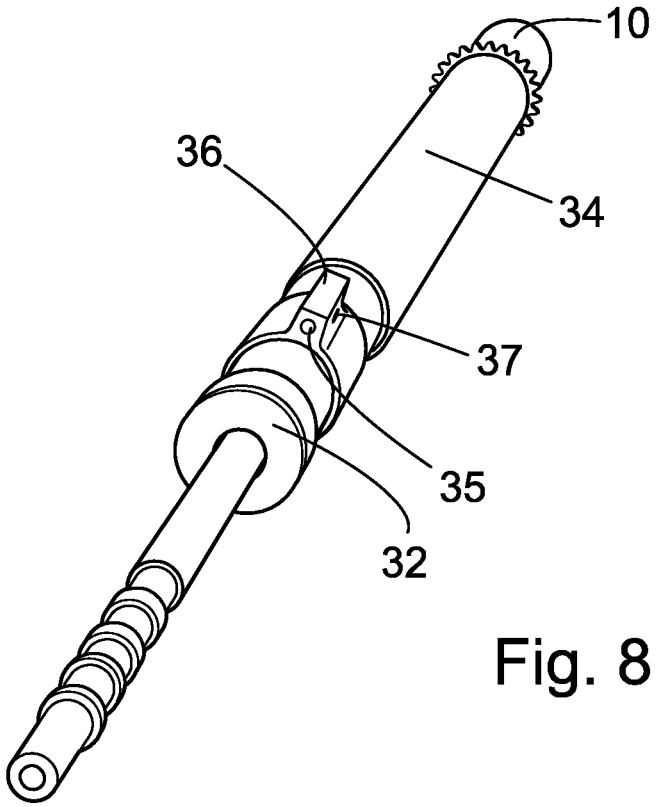

Referring to FIG. 8, a gas block 36 placed on barrel 12 in the illustrated embodiment. Gas block 36 includes a gas tube retaining pin hole 35 facing towards the muzzle and a gas adjustment screw 37 and associated screw receiving opening disposed on a side of gas block 36. The gas block 36 should be in line with a breach locating pin. The brass pressing guide 32 is placed on barrel 12 as is rear jacket tube 34 at the rear of gas block 36. Care should be taken to ensure that gas block 36 is aligned with a gas port on barrel 12, or near exact alignment at the location of the barrel's gas port in relation to the breach locating pin. Confirmation can be performed using water flow testing. The sub-assembly should be placed on the press and the parts pressed fit together, leaving no gaps and set screw holes line up with indentations on barrel 12. Water flow testing can be performed at this point to ensure that the gas port holes are properly aligned.

Figure 9:
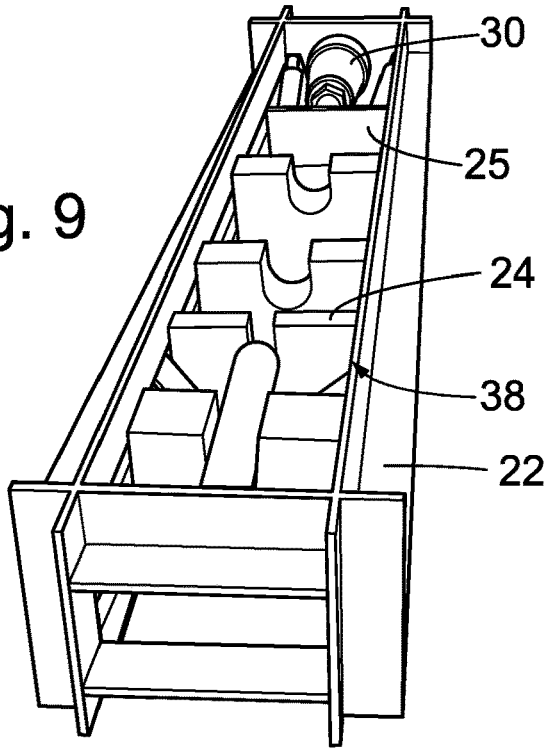

Referring to FIG. 9, pressure can be released from press block 22 and the barrel sub-assembly removed. The brass pressing guide 32 can be removed from the barrel sub-assemble. The press plate 24 is placed in a third position, designated generally as 38, which is further from piston 30 than in the first and second positions. Once the barrel sub-assemble is removed, the various parts are inspected for gaps and the gas block set screw(s) 37 are torqued.

Figure 10:
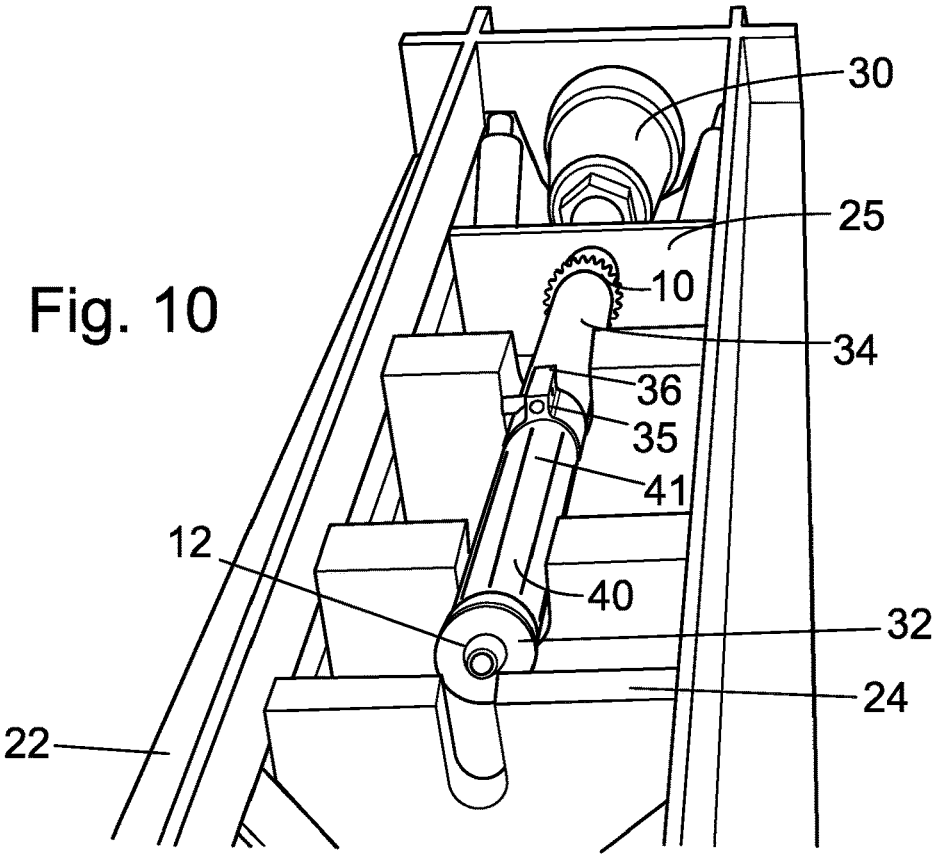

Referring to FIG. 10, a front jacket tube 40 can be positioned on barrel 12 at the front portion of gas block 36 opposite rear jacket tube 34. In one embodiment, flutes 41 of front jacket tube 40 should align with the center with gas tube opening 35 on gas block 36. The brass pressing guide 32 is placed on the barrel sub-assembly and the barrel sub-assembly is placed in press block 22. The press block 22 can then be used to press fit the various components and to seat front jacket tube 40 on to a front portion of gas block 36. In one embodiment, gas block set screw(s) 37 are torqued in the range of about 18 to about 26 psi. In one embodiment, an adhesive can be placed on the gas block set screw(s) 37 to reduce the ability of the screws to rattle lose.

Figure 11:
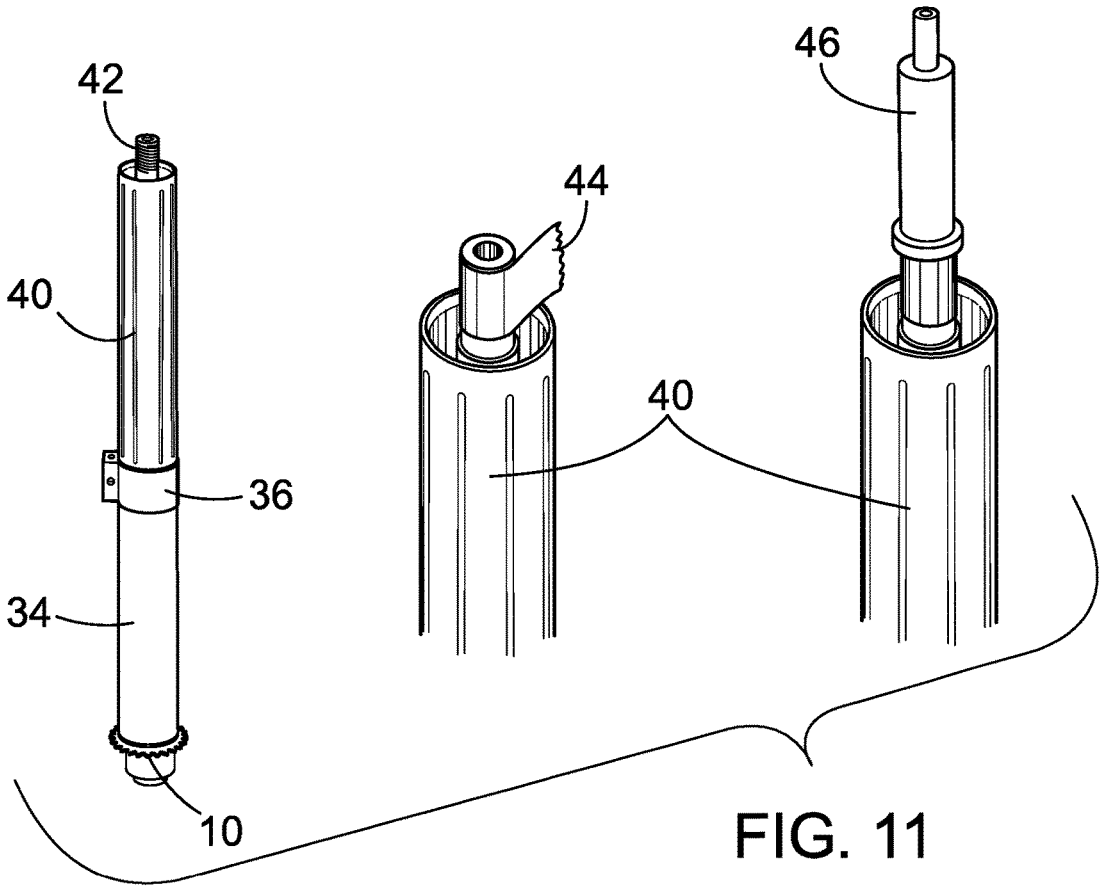
Figure 12:
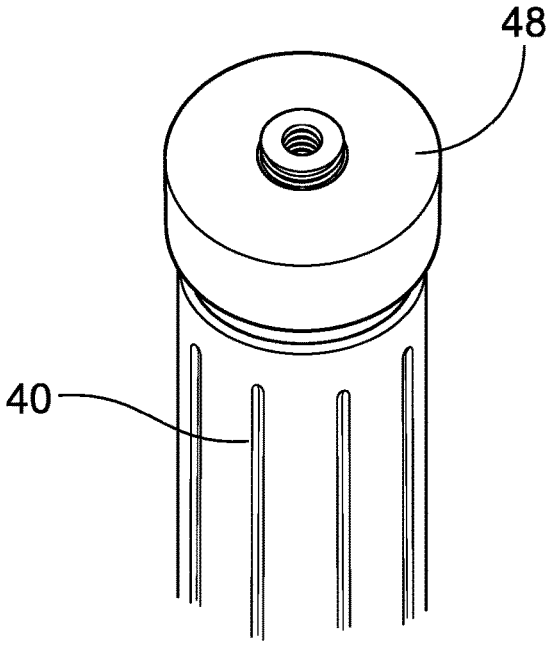

Referring FIG. 11, the threads 42 of at the muzzle of barrel 12 can be covered such as with tape 44. A brass pouring guide 46 can be placed over the bore of barrel 12. A filler that is includes between 200 and 350 grams of a solidifying composite, between 50 and 150 grams H2O, and between 35 and 75 grams of CU powder can be poured into front jacket tube 40 and flow to rear jacket tube 34 filling any void created between barrel 12 and rear jacket tube 34 and front jack tube 40. The pouring guide 46 can be used to create surface tension causing the filler to flow down pouring guide 46 and into jacket tubes 40 and 34, respectively. In one embodiment, the filler is poured to a level 0.5 inches below the muzzle edge of front jacket tube 40. The pouring guide is then removed and any filler wiped from the exposed portion of barrel 12. A centering device 48 can be press fit onto barrel 12 around threads 42 so that it is received on front jacket tube 40 to assist in the concentricity during phase change of the filler. In one embodiment, the centering device should be placed on barrel 12 with a few minutes of the filler being poured into jacket tube 40. Any filler that leaks from the barrel sub-assembly indicates that the parts are not properly fit.

In one embodiment, the filler material filler should be allowed to cure in a vertical position for a pre-determine period of time such as two or more hours to allow the barrel sub-assembly to be moved. The centering device can be removed. Water flow testing can be performed at this stage to check for leaks in gas block 36. The barrel sub-assembly can be placed under heat in the range of 400° F. to 600° F. for a predetermined period of time such as in excess of three hours. After the barrel sub-assembly is cooled, residue that may accumulated can be removed with mild abrasion.

Figure 13:
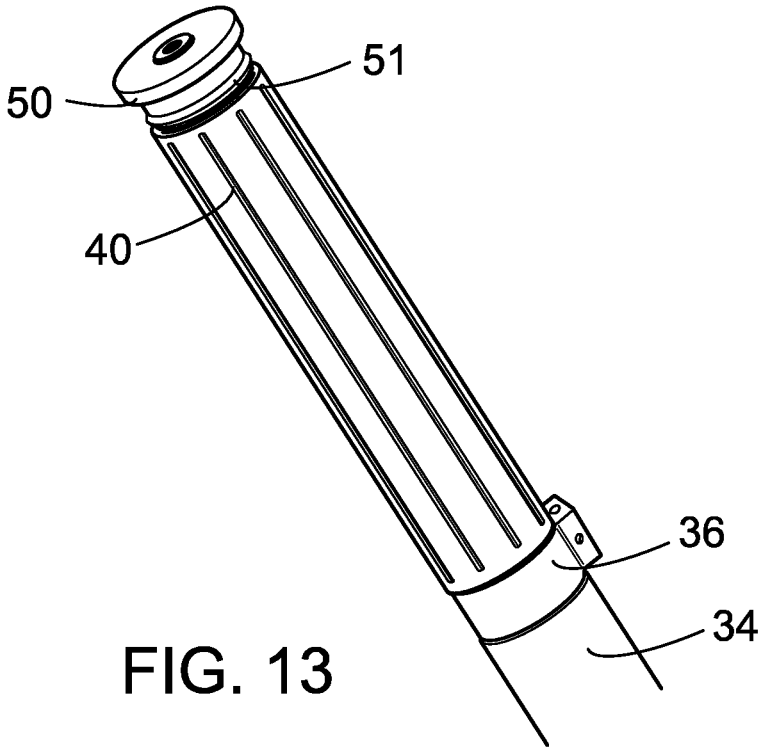

Referring to FIG. 13, a muzzle brake cap 50 can be placed on the muzzle end of front jacket tube 40 and proper alignment can be checked. The barrel sub-assembly can be placed in press block 22 to press muzzle brake cap 50 in place. A muzzle brake shimming washer 51 can be placed over barrel 12 at the muzzle disposed adjacent to muzzle brake cap 50.

Figure 14:
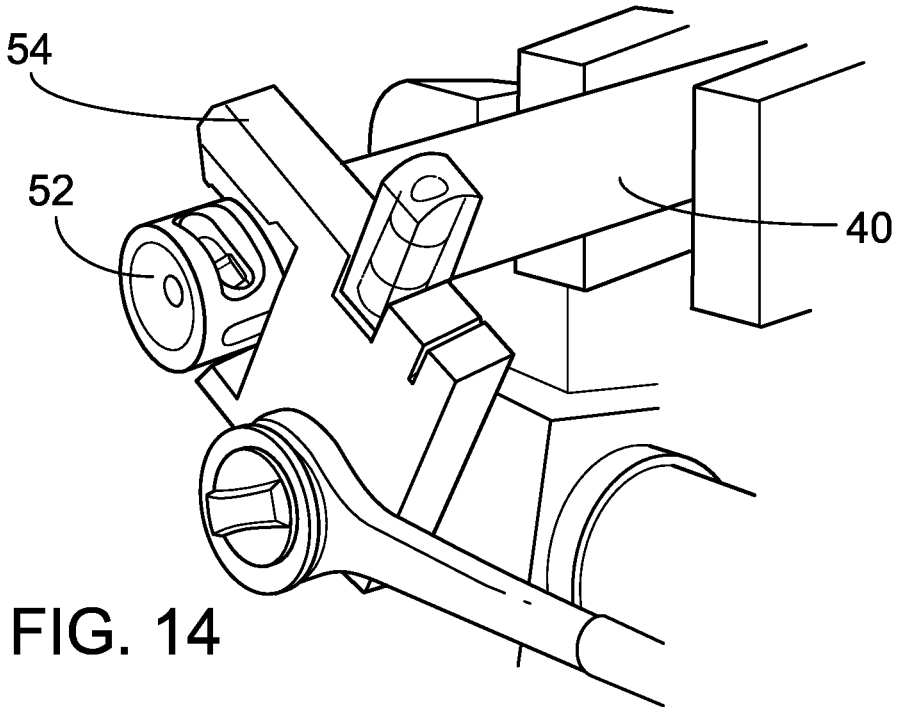

Referring to FIG. 14, a muzzle brake 52 can be threaded onto the threads 42 of barrel 12 and secured to barrel 12. The muzzle brake 52 can include grooves in the outer perimeter that can be engaged with a muzzle brake tool 54 that can be used to tighten muzzle brake 52 onto threads 42 of barrel 12. The muzzle brake tool can include a handle to can be attached to a wrench to provide sufficient leverage or torque to tighten the muzzle brake.

The rear jacket tube 34 can be imprinted with the necessary information such as caliber, manufacturer, and the like. The bore and chamber can be protected prior to the process of media blasting the complete barrel assembly. Once the barrel assemble is media blasted is can be cleaned and then heated in excess of 275° F. for at least 20 minutes to remove oils, grease and other debris. Once the barrel assembly surface cools to 100° F., the surface treatment can be applied. The bore and chamber and other area can be protected from over spray. The barrel assembly can be sprayed Cerakote or other protecting substance. Once the barrel assembly dries, more than 2 hours in one embodiment, the barrel assembly can be cleaned, (e.g. with acetone).

Once completed, a gas tube can be placed in gas block tube receiving opening 35 of gas block 36, the barrel placed on the action, hand guards installed as needed, handgrip installed, bore cleaned, and other steps needed for assembly. In one embodiment, the barrel assembly is transported prior to firearm assembly.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A method of modifying a firearm barrel comprising the steps of:

milling an existing barrel to create a sloped area with a larger diameter at a chamber end;

placing a barrel nut on the barrel;

placing a chamber bushing having a step on the barrel with the step disposed at the chamber end adjacent said barrel nut;

placing a rear jacket tube around the barrel adjacent said chamber bushing;

placing a brass pressing guide on the barrel and placing the barrel with the brass pressing guide and the rear jacket tube in a press and press fitting the rear jacket tube onto said chamber bushing so that the rear jacket tube abuts the step of the chamber bushing;

placing a gas block on the barrel adjacent to the rear jacket tube and pressing the gas block together with the rear jacket tube using the press;

placing a front jacket tube around the barrel adjacent to the gas block and pressing the front jacket tube together with the gas block using the press;

covering the threads disposed at the muzzle end of the barrel and placing a pour guide on the muzzle end of the barrel;

pouring a filler on said pour guide so that the filler is directed into and fills a void between the front jacket tube, rear jacket tube and barrel;

placing a centering device on the barrel so that it is operatively associated with the front jacket tube to center the barrel in the front jacket tube while the filler is curing;

placing a muzzle brake cap on the barrel and pressing the muzzle cap into the front jacket tube using the press; and, attaching a muzzle brake.

2. The method of claim 1 including attaching the barrel to a firearm.

3. A method of modifying a firearm barrel comprising the steps of:

providing a barrel for use with a firearm platform;

placing a barrel nut on the barrel at a chamber end of said barrel;

placing a chamber bushing on said barrel at said chamber end of said barrel adjacent said barrel nut;

placing a jacket tube around said barrel adjacent said chamber bushing;

pressing fitting said barrel nut, chamber bushing and jacket tube together so that no gaps exist between them; and, filling a void defined between said jacket tube and said barrel with a filler;

whereby a barrel assembly is provided for increased accuracy.

4. The method of claim 3 including milling said barrel to create a sloped area with a larger diameter at a chamber end and a small action moving toward the muzzle end, and wherein said barrel nut is fixed to said barrel adjacent said sloped area.

5. The method of claim 4 wherein said chamber bushing includes a step with said step disposed toward said chamber end of said barrel, and wherein said chamber bushing is disposed over said sloped area of said barrel and abuts said barrel nut.

6. The method of claim 5 including placing a pressing guide on said barrel adjacent said chamber bushing; placing said barrel in a press block and press fitting said chamber bushing and said barrel nut together.

7. The method of claim 6 wherein said jacket tube includes a rear jacket tube placed on said barrel adjacent said chamber bushing; placing a pressing guide on said barrel adjacent said rear jacket tube; placing said barrel in a press block and press fitting said rear jacket tube, said chamber bushing and said barrel nut together so that the rear jacket tube extends over at least a portion of said chamber bushing and abuts said step of said chamber bushing.

8. The method of claim 7 including placing a gas block on said barrel adjacent to said rear jacket tube; placing a pressing guide on said barrel adjacent said gas block; placing said barrel in a press block and press fitting said gas block, said rear jacket tube, said chamber bushing and said barrel nut together.

9. The method of claim 8 wherein said jacket tube includes a front jacket tube placed on said barrel adjacent said gas block; placing a pressing guide on said barrel adjacent said front jacket tube; placing said barrel in a press block and press fitting said front jacket tube, said rear jacket tube, said chamber bushing and said barrel nut together.

10. The method of claim 3 including covering threads disposed at a muzzle end of said barrel before placing said filler into said void between said barrel and said jacket tube.

11. The method of claim 3 including placing a pour guide on said muzzle end of said barrel for directing said filler into said void.

12. The method of claim 3 including placing a centering device on said barrel so that it is operatively associated with said jacket tube to center said barrel in said jacket tube while said filler is curing.

13. The method of claim 3 including placing a muzzle brake cap on said barrel and pressing the muzzle cap into said jacket tube.

14. The method of claim 3 wherein said filler includes between about 200 to 350 grams of a solidifying composite, between about 50 to 150 grams H2O, and between about 35 to 75 grams of CU powder.

15. The method of claim 3 wherein said filler is added to a level 0.5 inches below a muzzle edge of said jacket tube.

16. The method of claim 3 including curing said filler in a generally vertical position for at least about two hours.

17. The method of claim 16 including heat said barrel assembly in the range of 400° F. to 600° F. for at least about three hours.

18. The method of claim 3 including attaching a muzzle brake to said muzzle end of said barrel.

19. A modified barrel assembly for a firearm comprising:

a barrel for use with a firearm platform;

a barrel nut placed on said barrel at a chamber end of said barrel;

a chamber bushing placed on said barrel at said chamber end of said barrel adjacent said barrel nut;

a rear jacket tube placed on said barrel adjacent said chamber bushing;

a gas block placed on said barrel adjacent said rear jacket tube;

a front jacket tube placed on said barrel adjacent said gas block; and, a filler disposed between said barrel and said front and rear jacket tubes;

wherein said barrel nut, chamber bushing, rear jacket tube, gas block and front jacket tube are press fit together so that no gaps exist between them.

20. The barrel assembly of claim 19 wherein said filler includes between about 200 to 350 grams of a solidifying composite, between about 50 to 150 grams H2O, and between about 35 to 75 grams of CU powder; and wherein said filler is added to a level 0.5 inches below a muzzle edge of said jacket tube.

* * * * *